United States Patent [19]

Rohde

[11] 4,174,946

[45] Nov. 20, 1979

[54] PROCESS FOR DRYING COAL IN TWO-STAGE FLOW-THROUGH CIRCULATION HEATERS

[75] Inventor: Wolfgang Rohde, Essen, Fed. Rep. of Germany

[73] Assignee: Bergwerksverband GmbH, Essen, Fed. Rep. of Germany

[21] Appl. No.: 829,254

[22] Filed: Aug. 30, 1977

[30] Foreign Application Priority Data

Sep. 9, 1976 [DE] Fed. Rep. of Germany ..... 2640508

[51] Int. Cl.[2] ..... F27B 15/00

[52] U.S. Cl. ..... 432/14; 34/10

[58] Field of Search ..... 432/14, 15, 58; 34/10

[56] References Cited

U.S. PATENT DOCUMENTS

| | | | |
|---|---|---|---|
| 3,238,634 | 3/1966 | Goins | 34/10 |
| 3,884,620 | 5/1975 | Rammler | 34/10 |
| 4,082,498 | 4/1978 | Offergeld et al. | 432/14 |

*Primary Examiner*—John J. Camby

*Attorney, Agent, or Firm*—Michael J. Striker

[57] ABSTRACT

Coal is dried by passing it successively to two tubular flow-through circulation heating elements together with a heat carrier gas, withdrawing the partially dried coal emanating from the first heating element and passing it into the inlet end of the second heating element and recovering the substantially dry coal from the gas and coal mass emanating from the second heating element, the hot vapors received from the outlet end of the first heating element being recirculated after mixing them with fresh combustion gases into the second heating element and the heat carrier gas emanating from the second heating element after separation of the coal therefrom being passed after mixing with fresh combustion gases into the first heating element.

7 Claims, 3 Drawing Figures

PROCESS FOR DRYING COAL IN TWO-STAGE FLOW-THROUGH CIRCULATION HEATERS

BACKGROUND OF THE INVENTION

The invention relates to a process for drying coal by means of a two-stage process involving flow-through circulation heating elements.

It is known to effect the drying in the first stage and the further heating in the second stage by means of two flow-through circulation heaters which are operated by means of combustion gases. This permits to obtain a favorable thermal efficiency. The temperature of the combustion gases at the entrance to the second stage must be kept low at about 550° in order to prevent a treatment which would affect the quality of the coal. At higher entrance temperatures there is danger of an interference with the coking properties of the dried coal. There may even start an initial degasification or a certain pyrolytic modification of individual carbon grains.

On the other hand it is a definite disadvantage if the temperature of the vapors received from the first stage is close to the condensation point of the steam since the then possible drop formation in case of continuous operation may cause damages to the rotor of the blower since before the vapors are permitted to pass into the atmosphere they must go through a blower and subsequently through a dust separator, for instance an electrofilter or a cloth filter. In these dust separators the water drop formation can also have undesirable effects, for instance deposits of extremely finely divided carbon which are very difficult to remove or crust formation at the filter plates of the electrofilter or of the filter cloths.

Particular difficulties can arise if sulfur-containing gases are subjected to combustion in the combustion chamber since in that case the combustion gas, and therefore also the emanating vapors will contain a certain amount of sulfur dioxide. Since the sulfuric acid condensation point is between about 170° and 180° C. there forms sulfuric acid, particularly in the blower and dust separator already below this temperature range.

It has previously been proposed to prevent a comparatively low vapor exit temperature in case of two-stage flow-through circulation heating elements by reducing the coal throughput through the circulation heaters. This artifice, however, interfers with the economics of the process.

The present invention therefore has the object to even improve the throughput of coal in case of two-stage flow-through circulation heaters without reaching the dangerous temperature range below the dewpoint formation and below the condensation point of sulfuric acid.

SUMMARY OF THE INVENTION

This object is solved according to the invention by operating the first stage by high calory combustion gases and outgoing gases from the second heater and then introducing a part of the vapors emanating from the first stage which now has a higher temperature into the mixing chamber associated with the combustion chamber so as to form a low-calory gas which is then passed into the second stage.

In this manner it is accomplished that behind the first stage of the flow-through circulation heater the combustion gases which have been mixed with the vapors leave the first heater at a temperature of about 150° to 250° C. In addition, the throughput of the two-stage process can be increased far above the level of the prior art and at the same time the problem of reaching temperatures below the dewpoint and of water and of carbon dioxide-containing gases can be solved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
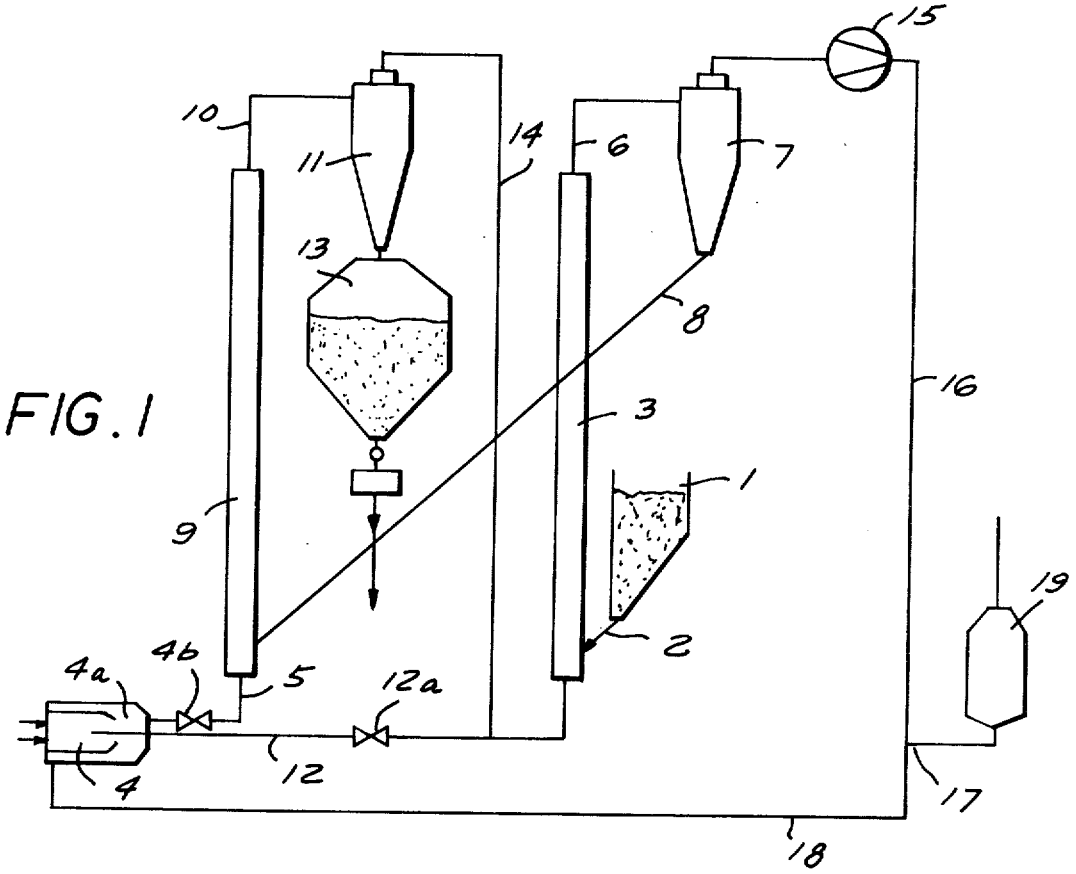
FIG. 1 is a schematic drawing of the process employed in the invention.

With reference now to FIG. 1 it will be seen that coking coal which generally should have a grain size between 0.06 and 6 mm and a moisture content up to 10% is passed from a storage bin 1 through the line 2 into a first flow-through circulation heater 3. The heater is in elongated form and may be a round tube or an angular element.

In the combustion chamber 4 the high calorie combustion gases are generated for the drying process. They are mixed in an antechamber 4*a* with vapors recirculated via the duct 18 from the first heating element. As a result a low calorie gas of a temperature of about 550° C. is formed. This low calorie gas is passed through the valve 4*b* and the duct 5 into the lower end of the second flow-through circulation heater 9 which is of a similar form as the heating element 3. The gases and coal leave the heater 9 through a duct 8, pass into a cyclone separator 11 and are then passed through a duct 14 back into the first circulation heater. However, prior to entry into the first heater 3 the heat carrier gas from the second stage after separation of the coal is mixed with high-calorie combustion gases passed from the combustion chamber 4 through the line 12. These gases have a temperature of about 1500° C. They are mixed with the heat carrier gas from the second heating element 9 whereby the temperature of the heat carrier gas is raised to about 300° C. In this form the mixture is introduced into the heating element 3 which results at a temperature of the heat carrier gas and vapors at the outlet of the first heating element of about 200° C.

The heat carrier gas and vapors from the first heating element are passed through a line 6 into a cyclone separator 7. The coal separated in the cyclone then is caused to slide through line 8 into the lower end of the second heating element 9. The temperature of the heating gas emanating from the second heating element will be about 280° C. The carbon and gas emanating from the second heating element are separated in the cyclone 11 and the substantially dry carbon is passed into a storage vessel 3 for further recovery.

The vapors coming out of the separator 7 associated with the first heating element 3 are driven by means of a blower 15 into a duct 16 where part of the vapors is passed via a duct 17 into a dust separator 19 and from there into the atmosphere. Another part of the vapors is recirculated into the mixing chamber 4a as already stated further above. The mixture of these vapors and the high calorie combustion gases is then passed as also pointed out through duct 5 into the second heating element 9.

Figure 2:
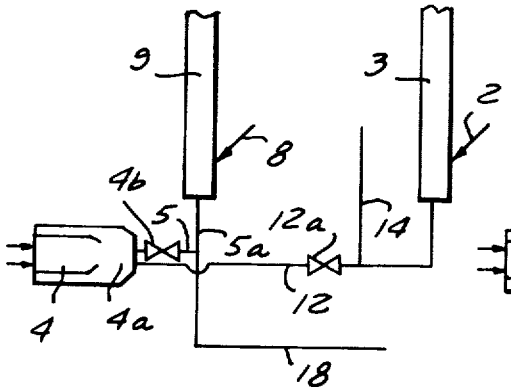
FIG. 2 is a partial representation of a variation of the process.

FIG. 2 is a modification of the shown process wherein the vapors from the first heating stage are directly recirculated via a duct 5a into the second heating element 9. The high calorie combustion gases in this case are not mixed with the vapors in a separate mixing chamber associated with the combustion chamber but are passed into the lines 18a and 5a via a duct 5 prior to entry of the vapors and combustion gases into the second heating element.

In this case the combustion gases for the second stage are subject to a cooling to about 550° C. by means of the vapors from the first stage with which they are merged in the duct 5a.

Figure 3:
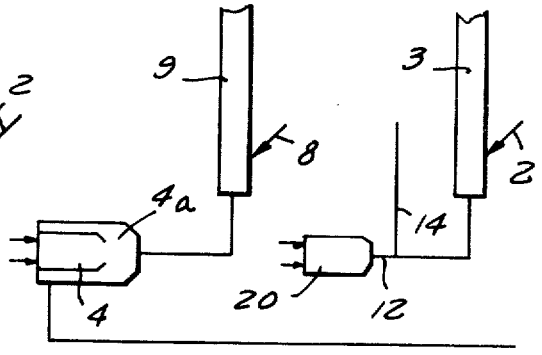
FIG. 3 is a similar representation of another variation of the process.

FIG. 3 illustrates another modification where there is provided a separate combustion chamber 4 for generating combustion gases for the second heating element 9 and a combustion chamber 20 for providing the combustion gases for the first heating element 3.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a process of drying coal in a two-stage thermal operation of the type wherein coal is passed in finely divided form together with a fresh heat carrier gas into the lower end of a first elongated flow-through heating element, the coal and vapors withdrawn at the upper end of the first heating element are passed to a first separator where the partly dried coal is separated from the vapors, the separated coal and a fresh heat carrier gas are then passed into the lower end of a second elongated flow-through heating element, the coal and spent heat carrier gas withdrawn at the upper end of the second heating element are passed to a second separator, and the substantially dry separated coal is recovered from the second separator, the improvement comprising generating hot combustion gas having a temperature of about 1500° C.; mixing a portion of the hot combustion gas with the spent carrier gas withdrawn from said second heating element to obtain fresh carrier gas having a temperature lower than the combustion gas; admitting the thus obtained lower temperature carrier gas directly into said first heating element; mixing at least part of the vapors withdrawn from said first heating element with another portion of the hot combustion gas to obtain fresh carrier gas having a temperature higher than said vapors; and admitting the thus obtained higher temperature carrier gas directly into said second heating element.

2. The process of claim 1 wherein the vapors obtained from said first separator are passed directly into said second heating element and the hot combustion gas is passed into said vapors prior to their entry into the second heating element.

3. The process of claim 1 wherein the temperature of the heat carrier gas withdrawn from the second heating element is increased to in excess of 300° C. by said mixture with hot combustion gas prior to entry into said first heating element.

4. The process of claim 1 wherein the hot combustion gases prior to entry into said second heating element are cooled to about 550° C. by said mixture with said vapors withdrawn from the first heating element.

5. The process of claim 1 wherein the temperature of said combustion gases and vapors upon leaving the first heating element is about 150° to 250° C.

6. The process of claim 1 wherein the temperature of the heat carrier gas upon leaving the second heating element is about 280° C.

7. The process defined in claim 1, wherein the step of generating comprises producing two separate and distinct flows of combustion gas, and wherein all of the combustion gas of one flow is mixed with the spent carrier gas withdrawn from said second heating element and all of the combustion gas of the other flow is mixed with the at least part of the vapors withdrawn from said first heating element.

* * * * *